US007178311B2

(12) United States Patent
Hoogland

(10) Patent No.: US 7,178,311 B2
(45) Date of Patent: Feb. 20, 2007

(54) PLASTIC CONTAINER AND METHOD FOR THE USE THEREOF

(75) Inventor: Hendricus Antonius Hoogland, Krommenie (NL)

(73) Assignee: I-Pac Patents B.V., LC Capelle aan den IJssel (NL)

( * ) Notice: Subject to any disclaimer, the term of this patent is extended or adjusted under 35 U.S.C. 154(b) by 0 days.

(21) Appl. No.: 10/475,077

(22) PCT Filed: Apr. 12, 2002

(86) PCT No.: PCT/NL02/00245

§ 371 (c)(1),
(2), (4) Date: Apr. 5, 2004

(87) PCT Pub. No.: WO02/083508

PCT Pub. Date: Oct. 24, 2002

(65) Prior Publication Data

US 2004/0155037 A1 Aug. 12, 2004

(30) Foreign Application Priority Data

Apr. 13, 2001 (NL) ..... 1017844

(51) Int. Cl.
*B65B 55/06* (2006.01)
*B65B 43/00* (2006.01)
*B65D 6/18* (2006.01)
*B65D 19/18* (2006.01)

(52) U.S. Cl. ..... 53/426; 53/458; 53/564; 53/140; 220/6

(58) Field of Classification Search ..... 53/458, 53/140, 564; 220/6, 7; *B65D 6/18, 19/18*
See application file for complete search history.

(56) References Cited

U.S. PATENT DOCUMENTS

| | | | | |
|---|---|---|---|---|
| 3,360,180 | A * | 12/1967 | Venturi | 220/7 |
| 3,967,772 | A * | 7/1976 | Baker | 53/456 |
| 4,056,913 | A * | 11/1977 | Bamburg et al. | 53/471 |
| 5,450,962 | A * | 9/1995 | Uitz | 220/7 |
| 5,515,987 | A * | 5/1996 | Jacques et al. | 220/6 |
| 5,572,854 | A * | 11/1996 | Greiner et al. | 53/390 |
| 5,671,857 | A * | 9/1997 | Stromberg | 220/7 |
| 5,704,193 | A * | 1/1998 | Roe et al. | 53/456 |
| 5,865,315 | A * | 2/1999 | Uitz | 206/600 |
| 6,149,006 | A | 11/2000 | Brauner et al. | |
| 6,601,724 | B1 * | 8/2003 | Koefelda et al. | 220/6 |
| 6,648,159 | B2 * | 11/2003 | Prutkin et al. | 220/6 |
| 6,708,836 | B2 * | 3/2004 | Zelko | 220/7 |

FOREIGN PATENT DOCUMENTS

| | | |
|---|---|---|
| CH | 456 438 | 7/1968 |

(Continued)

*Primary Examiner*—Stephen F. Gerrity
(74) *Attorney, Agent, or Firm*—Hoffmann & Baron, LLP

(57) ABSTRACT

The invention relates to a method for storing and transporting products, wherein, from plastic, foldable containers are manufactured, in particular injection molded; the foldable containers, at a filling location, are brought in a set-up condition and are filled with products; the filled containers are transported to a position of use; the foldable containers are emptied and are collapsed; the containers, in collapsed condition, are returned to the filling location; and the containers are cleaned and reused. The invention further relates to a foldable container which is injection molded from plastic in one piece with integrated hinges, and to specific methods for use of such plastic container.

17 Claims, 4 Drawing Sheets

FOREIGN PATENT DOCUMENTS

Figure 3:
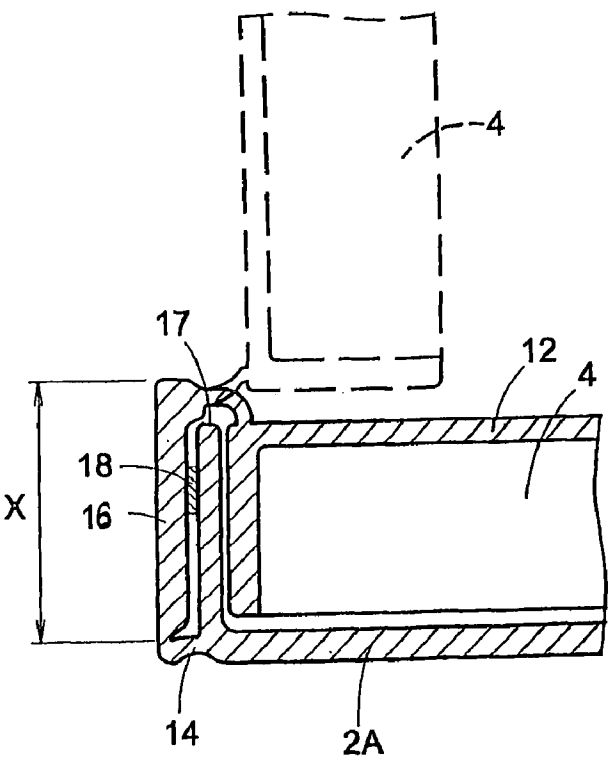

| | | | |
|---|---|---|---|
| DE | 12 21 958 | | 7/1966 |
| DE | 3444477 | * | 6/1986 |
| FR | 2682664 | * | 4/1993 |
| GB | 1 347 989 | | 2/1974 |
| WO | WO 1990/012738 | * | 11/1990 |
| WO | WO 93/13991 | | 7/1993 |

* cited by examiner

PLASTIC CONTAINER AND METHOD FOR THE USE THEREOF

This application is the U.S. National Phase of International Application Number PCT/NL02/00245 filed on 12 Apr. 2002, which is incorporated herein by reference.

BACKGROUND OF THE INVENTION

The invention relates to a method for storing and transporting products. Such a method is known from practice.

In this known method, for instance French fries in frozen condition are packaged in a plastic bag, which is closed off and subsequently packaged in a cardboard outer box. In these packages, the French fries are stored in cold storage plants and transported to a user, who takes the French fires from the package and subsequently discards the package, prior to which this has to be separated into plastic and cardboard.

It is further known to package products, for instance fresh fish, in plastic crates. These plastic crates are reused, but take up a particularly great deal of space, full as well as empty, for storage and transport. Moreover, these crates are destroyed after their economic life span.

The object of the invention is to provide a method of the type described in the preamble, wherein the above-mentioned drawbacks of the known methods are avoided, while maintaining their advantages.

SUMMARY OF THE INVENTION

With a method according to the invention, in a particularly economical and environmentally friendly manner, packaging, storage and transport of products of a diverse nature can be provided for. The foldable containers render it possible to package and handle products whether or not in bulk, while returning and storing empty containers takes up particularly little space. The containers can easily be cleaned and be reused. It is preferred that the containers, after having reached the end of their economic and/or technical life span, are ground or otherwise reduced, after which the thus obtained plastic parts are reused for again manufacturing a container for use within the invention.

The containers for use within the invention are preferably injection molded in one piece, with integrated hinges, so that no assembly steps are necessary and it is prevented that, during use, parts of the containers become separated from each other. Additionally, in this manner, fragile parts are further avoided.

Covering the container after it has been filled offers the advantage that the products are particularly well protected. Use of foil which is fixed, in particular sealed, onto or near the upper side on the container, offers the advantage that such a covering can be applied rapidly and readily, does not yield any packaging and is further easy to individualize for the respective products. Further, other coverings can also be used, such as lids, and other manners of fixation can be applied, for instance gluing.

The invention further related to the packaging of products in a plastic container.

With such a method, in a particularly simple and safe manner, products can be packaged, shielded from the surroundings. The foil can be easily printed for individualizing the contents of the container and does not yield any packaging.

The plastic containers are preferably cleaned, in particular sterilized, at each cycle of use, to which end preferably steam is used.

The invention further relates to a foldable container.

Such a container offers the advantage that it can be manufactured and used in a simple and relatively low-cost manner. Assembly steps are practically not necessary. Additionally, the advantage is thereby obtained that no parts can come loose unintentionally, which might otherwise render the container unusable.

Such a container can be injection-molded substantially flat, so that a particularly simple injection mold can be used. Additionally, relatively simple injection-molding machines will suffice. As a result, the container can be manufactured in a simple and relatively inexpensive manner. The specific construction with the lips on the end walls offers the advantage that a container is obtained which is still relatively stiff and which can be collapsed particularly compactly.

The invention further relates to the use of a foldable plastic container.

Such use of a foldable plastic container offers the advantage that, in a suitable manner, products can be packaged, stored and transported, while the packaging, i.e. the container in empty condition, takes up relatively little space. The plastic containers are preferably used a few to many cycles, after which they are reused for manufacturing new, comparable containers.

The invention further relates to the use of plastic containers.

In such use, the advantage is achieved that products are particularly well packaged and protected against influences from the outside. Especially with products sensitive to ambient conditions, such as perishables, in particular food, this is particularly advantageous.

In the additional subclaims, further advantageous embodiments of methods, devices and methods of use according to the invention are given. To clarify the invention, embodiments thereof will be further elucidated with reference to the drawing.

BRIEF DESCRIPTION OF TILE DRAWINGS

Figure 1:
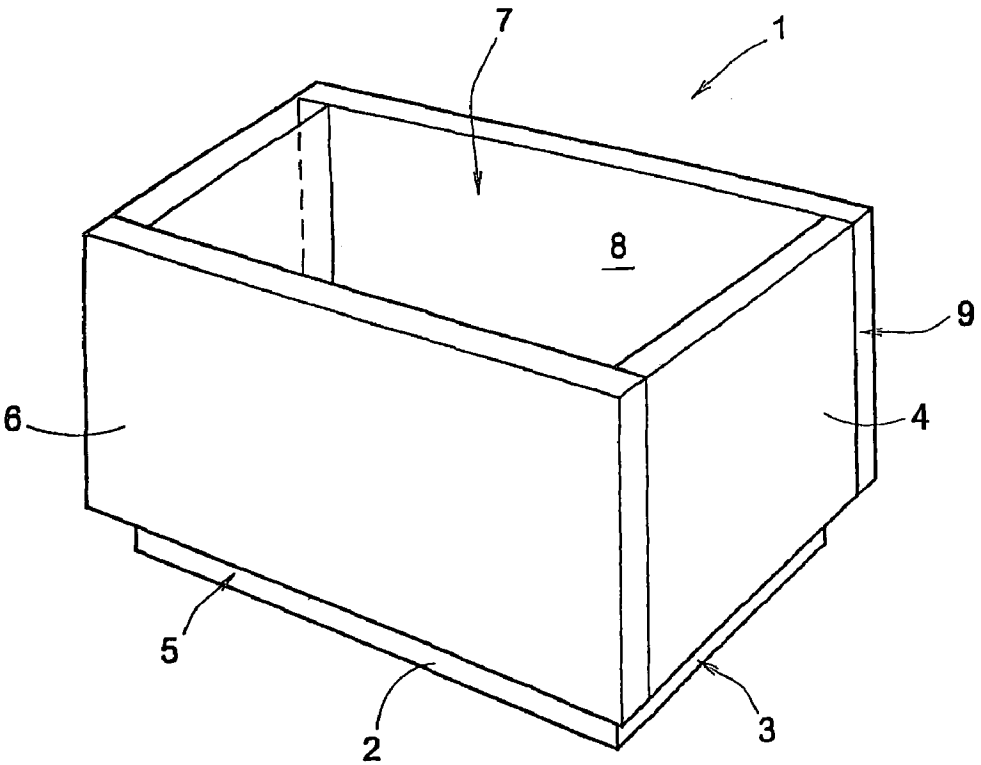
Figure 2:
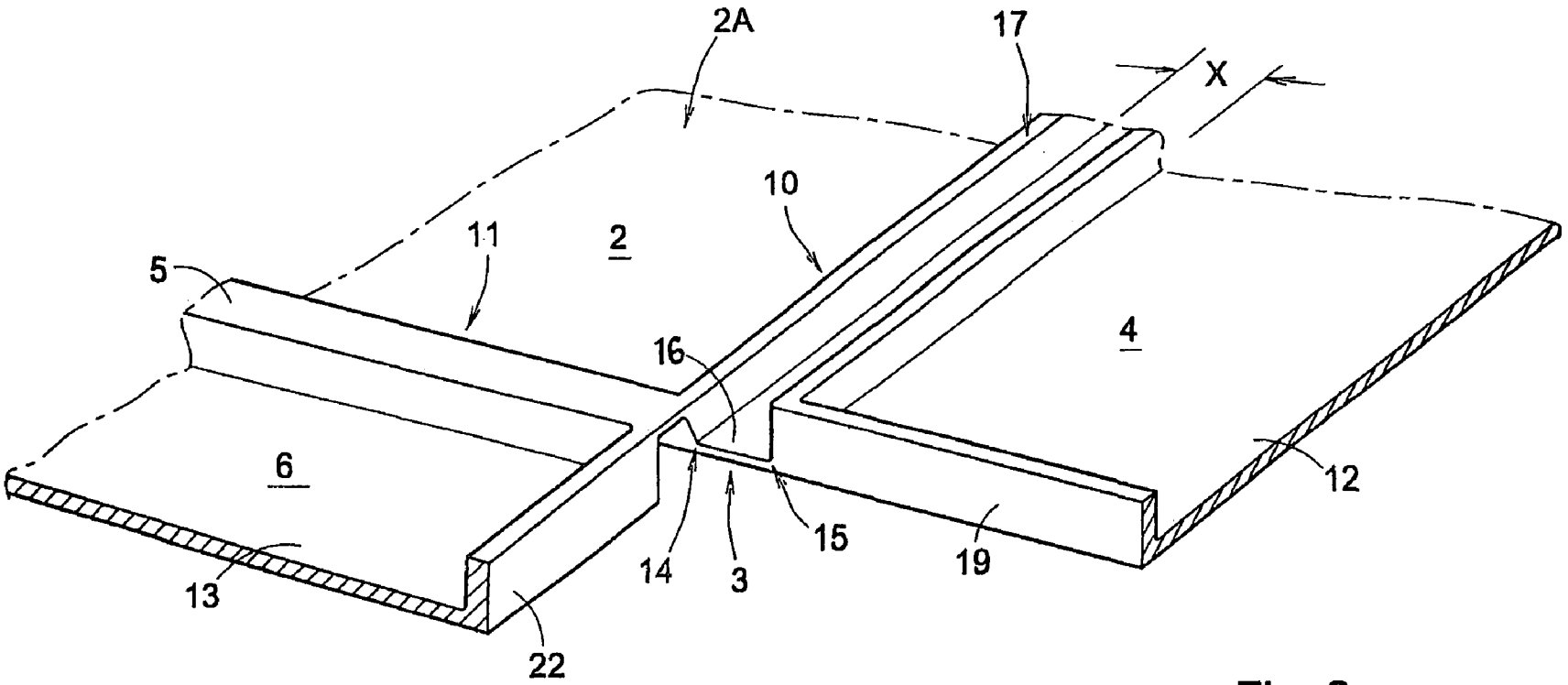
Figure 5:
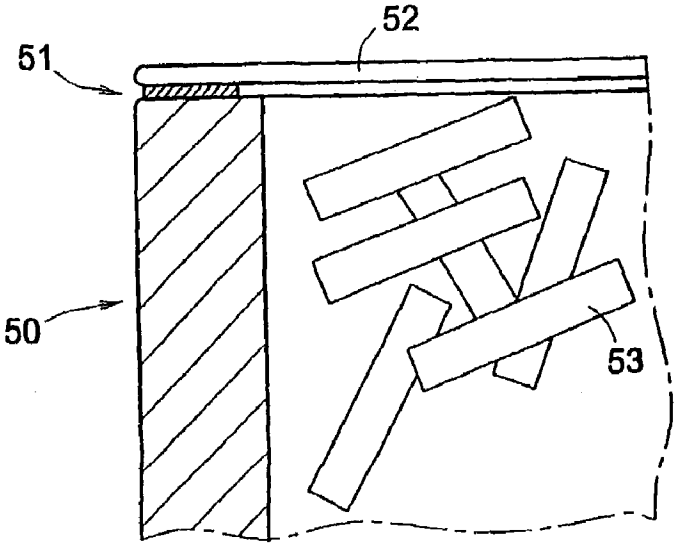
Figure 6:
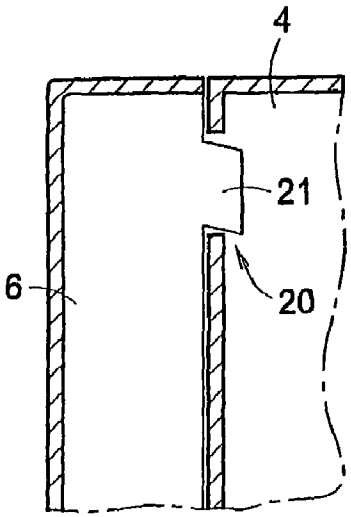
Figure 4:
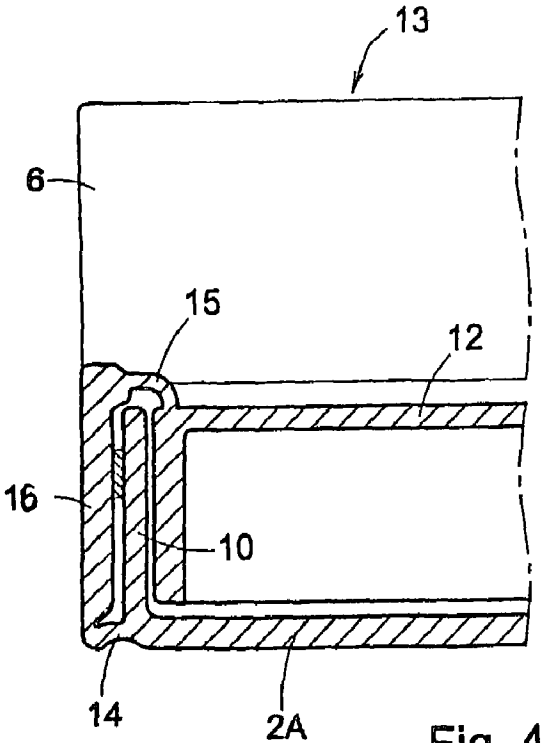
Figure 7:
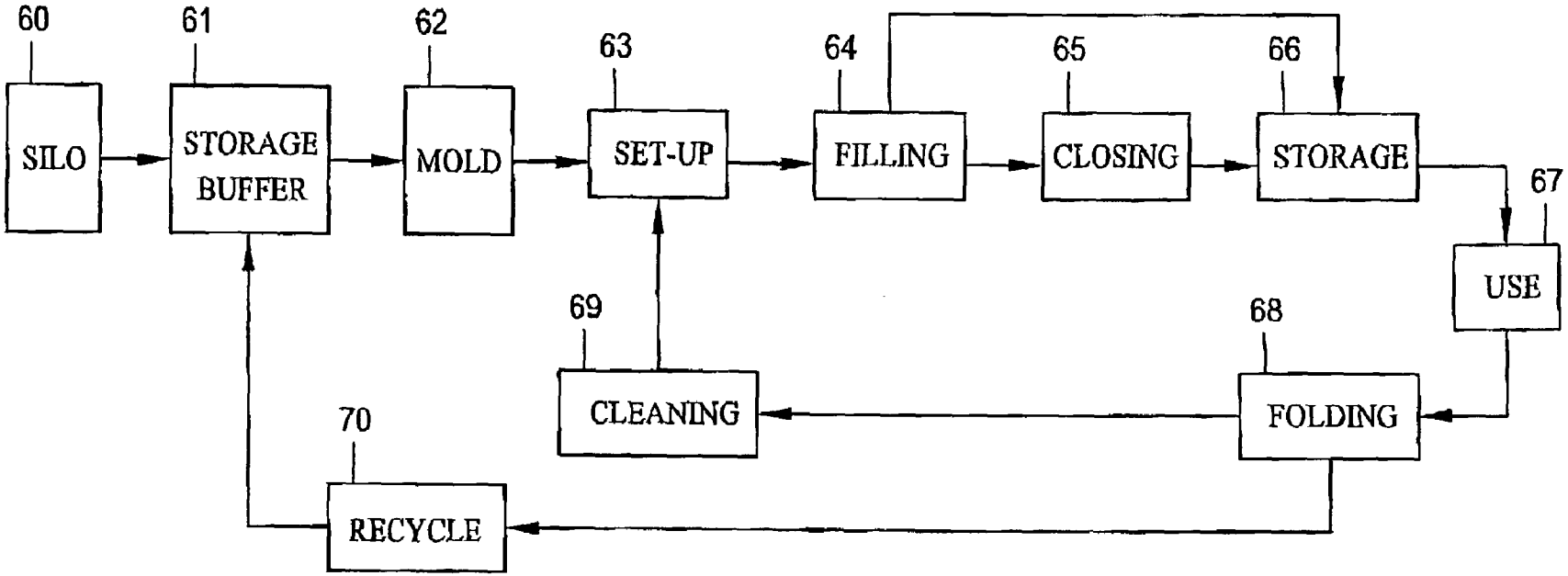

In the drawing:

FIG. 1 schematically shows, in perspective view, a set up container according to the invention;

FIG. 2 schematically shows, partly in perspective view, a container according to FIG. 1, in flat condition, immediately after injection-molding;

FIG. 3 schematically shows, in enlargement, a detail of a connection between an end wall of a container according to FIGS. 1 and 2, in set-up condition for use;

FIG. 4 schematically shows, in cross section, a pair of a container according to the invention, in collapsed condition;

FIG. 5 schematically shows a detail of a covering fixed to an upper longitudinal edge of a container according to the invention;

FIG. 6 schematically shows a detail of a connection between an end wall and a side wall; and FIG. 7 schematically shows a cycle of use of a container according to the invention.

DETAILED DESCRIPTION OF THE INVENTION

In this description, identical or corresponding parts have identical or corresponding reference numerals. In this description, the starting point in each case are plastic containers in the form of crates. It will be clear that these can be designed in many variants, particularly as to size, plastics used and mixtures thereof, and constructions of, for instance, bottom and walls, all within the scope of the invention as outlined by the claims. In this description, containers the use thereof and methods will be described on the basis of an example, viz, the packaging of foods, in particular French fries and the like. The invention should not, however, be construed as being limited thereto. Additionally, within the containers, subpackages can be used, for instance portion packages or the like.

FIG. 1 schematically shows, in perspective view, an injection molded plastic crate 1 according to the invention, comprising a tray-shaped bottom 2, two end walls 4 connected thereto via first film-hinges 3, and two side walls 6 connected to the bottom via send film-hinges 5. In set-up condition, the walls 4, 6 define an inner space 7 which is open at the top via a removal opening 8. The walls 4, 6 abut each other by their short sides, thereby forming ribs or connecting seams 9, which are preferably closed, for instances by suitable sealing means such as integrally injection-molded backs, flaps or the like.

FIG. 2 represents a corner of a bottom 2, having connected thereto a part of an end wall 4 and a side wall 6 as well as the first and second film hinges 3, 5. The bottom 2 comprises upright longitudinal edges 10, 11, while the end walls 4 and the side walls 6, like the bottom, are tray-shaped. In this embodiment, with the crate 1 set up, the closed wall parts 12, 13 of the walls 4, 6 face the inner space 7. The side wall 6 is connected through the second hinge 5 to the free upper edge of the respective longitudinal edge 11 of the bottom 2, and, for clarity's sake, is represented in a relatively thick and broad manner. It will be clear that the side wall, with the aid of this hinge 5, can be swung both to a vertical position, at least approximately at right angles to the bottom 2, and further, so as to lie flat on the bottom 2, as is indicated in FIG. 4. The first film hinge 3 is formed by a lip 16, limited on both sides by a subhinge 14, 15 of the living hinge type, i.e. an integrally injection-molded hinge. The first subhinge 14 is connected to the bottom 2 near the lower side of the respective longitudinal edge 10, i.e. at a height approximately equal to the closed bottom surface 2A. The second sub-hinge 15 is connected to the end wall 4, approximately in the plane of the closed wall part 12 thereof. The lip 13 has a width X which is chosen such that is at least approximately equal to and preferably somewhat greater than the height of the longitudinal edge 10 of the bottom 2. The purpose of this will be elucidated later.

As is clear from FIG. 2, the container 1 can be injection-molded substantially flat. This requires a relatively simple mold and injection molding device. After the container 1, as shown in FIG. 2, is taken from the mold, preferably when it is still warm, the lip 16 of each end wall 4 is folded against the adjacent longitudinal edge 10 and fixed against it, for instances by welding, gluing a suitable clamped joint or snap connection or the like. In FIG. 3, this connection 18 is represented by a black cube. The first subhinge 14 only needs to allow bending a single time, and therefore only needs to be a (warm) deformable wall element. Then, the second subhinge 15 is brought above the free upper edge 17 of the respective longitudinal edge 10 and the end wall 4 extends above that longitudinal edge 10 and the bottom 2. From this position, represented in broken lines in FIG. 3, which is the position of the end wall 4 when the crate has been set up, this wall 4 can be swung in the direction of the bottom 2 and be received between the longitudinal edges 10, 11, against the bottom surface 2A, as is shown in uninterrupted lines in FIG. 3. Subsequently, in a manner described earlier, the side wall 6 can be folded thereover, as is shown in FIG. 4, so that a compactly folded crate 1 is obtained.

FIG. 6 shows, in cross-sectional side view, an upper corner or a plastic crate 1, in which the side wall 6 and an abutting end wall 4 are clearly visible. In the longitudinal edge 19 of the end wall 4, an opening 20 is provided a pin 21, slightly inclining in the direction of the bottom 2. With a crate 1 set up, the pin 21 extends through the opening 20, so that the side wall 6 is connected to the end wall 4. When the crate 1 is lifted by the end walls 4, the wall parts 4, 6 are pulled against each other even more tightly. The pin 21 and the opening 20 are preferably self-directing. The longitudinal edge 22 of the side walls 6, for that matter, is preferably somewhat higher that the longitudinal edge 11 of the bottom of the bottom 2. With the crate 1 set up, the respective longitudinal edges 10 of the bottom 2, against the closed wall parts 12 of the end walls 4, so that further pivoting of the end walls 4 is prevented. Additionally, also between these longitudinal edges 22 and these wall parts 12, couplings means such as the pin 21 and hole 20 shown, can be disposed, optionally instead of those shown in FIG. 6. With such a connection, it is preferred that also the longitudinal edge 22 of the side walls 6 that faces away from the bottom extends above the end walls, and the coupling means are designed such that when lifting the crate by the side walls 4, these are pulled against the longitudinal edges 22 of the side walls, while upon lifting by the side walls 6, retention is obtained with the aid of the coupling means, for instance by inverting the direction of inclination of the pins 21. Naturally, also various other coupling means can be provided for coupling the side walls 6 and the end walls 4.

FIG. 5 shows an upper corner of a crate 50, which is manufactured from plastic. The crate 50 can be foldable, as a crate 1 according to FIGS. 1–4 and 6, but it can also have a fixed shape. One the upper edge 51, which is preferably of flat design, a foil 52 is sealed or otherwise connected, for instance glued, welded or the like. The foil is preferably substantially gas-and liquid-tight, and so is, preferably, the crate 50, and can be provided with a print (not shown) matching the products 53 brought into the crate 50, for instance French fries. The foil closes off the entire upper side and thus forms a good barrier against external influences on the products 53. Such a foil can simply be applied in an automatic manner.

FIG. 7 schematically shows a method for the use of crates, in particular collapsible plastic crates 1 for packaging, storing and/or transporting products. Plastic material, for instance a mixture of suitable polymers, which are resistant to temperatures below 0 degrees Centigrade, is supplied from a side 60 to a storage buffer 61. It will, for that matter, be clear to any skilled person which plastic materials can or must be used, depending on the requirements for use of the crates 1. From the buffer 61, plastic is supplied to an injection-molding device 62, in which the crates 1 are injection molded. After withdrawal, the crates are prepared for use, in particular by fixing the lips 16 against the longitudinal bottom edges 10. Subsequently, prior to use, the crate 1 is set up in a set-up station 63, after which the crates 1 are filled in a filling station 64. Thereupon, the crates 1 can be closed off in a closing station 65, for instance by sealing as described earlier, or by fitting a different, suitable closing means, such as a cover. From there, or from the filling station 64, the crates 1 can be stored and/or transported, indicated with the number 66. At a suitable position of use 67, at a desired moment, the crates are then taken out of storage 66 and emptied, for use of the products, after which the crates 1 are collapsed in a folding station 68 for returning the empty crates 1.

From the folding station 68, the crates 1 can be brought to a cleaning station, 69, where the crates are cleaned. To that end, for instance steam can be used, which is favorable for the environment and in terms of practical cleaning. Naturally, other techniques can also be used. When the crates are used, for instance, for perishables such as food, for medical equipment and the like, it is further advantageous when the crates are disinfected and optionally sterilized, in a manner appropriate therefor. Then, the crates 1 are ready to be refilled in the filling station 64, after having been set up in the set-up station 63. Naturally, cleaning can also be done after set-up.

The crates can be stacked into each other with the side walls 6 and/or the end walls 4, whereby the bottom 2 is received between the side walls and can provide further stability.

From the folding station 68, or possibly from the user station 67, the crates 1 can also be transported to a recycle unit 70, where the crates are ground or otherwise granulated for reuse of the plastic material, which can be mixed in the buffer 61 with other, and optionally new, material. Such recycling can be done at the end of the economic and/or technical life span of a crate 1 or at any other suitable or desired moment. As the crates are thus repeatedly reused, practically no material is lost, which is environmentally and economically advantageous. Only very little new material needs to be supplied.

The invention is no way limited to the embodiments represented in the description and the drawings. Many variations thereon are possible within the scope of the invention as outlined by the claims.

For example, the crates 1 can be designed to be collapsible in a different manner for use within a method according to the invention, or be designed to permit partial disassembly. Non-folding crates are also used in a method according to the invention as schematically shown in FIG. 7. Naturally, setting up and collapsing the crates in then omitted. Further, the hinges and other connecting constructions can be designed in a different manner. By using a tray-shaped bottom, the advantage is achieved that a stable bottom is obtained inside of which at least the end walls 4 can be folded. However, it is also possible to couple the end walls directly with a single hinge to the wall part 2A of the bottom, and then to leave out the upright longitudinal edge 10, or to give the longitudinal edge 10 only a lesser height and to connect it, via a hinge, to the adjacent longitudinal edge of the end wall 4, at a suitable height, such that the end wall can still be pivoted against the bottom 2, 2A. In the upright position, the end wall will then to some extent reach outside the contour defined by the bottom plate 2A.

These and many comparably variations are deemed to fall within the scope of the invention as outlined by the claims.

The invention claimed is:

1. A method for storing and transporting products comprising the steps of:

injection molding foldable containers from plastic, said containers being in one piece with integrated hinges, wherein the containers are provided with a tray-shaped bottom with upright edges, two end walls and side walls, wherein the bottom comprises four upwardly extending edges from a bottom plate, wherein the end walls are at least substantially foldable within the bottom between said edges, and the side walls are substantially foldable over the end walls, wherein the end walls are each integrally connected to said bottom by a respective lip provided at the outside of said bottom, each of said lips being respectively connected to an outside surface of one of said upwardly extending edges of said bottom;

folding said containers whereby said two end walls of the container are folded within the bottom between the edges, and whereby the side walls of the container are folded over the end walls;

filling the foldable containers with products at a filling location;

transporting the filled containers to a position of use;

emptying and collapsing the foldable containers after use; and returning the containers, in collapsed condition to the filling location, wherein the containers are cleaned and are reused.

2. A method according to claim 1, wherein the containers are filled and emptied a few times, after which the container is recycled by granulation and injection molding a foldable container again.

3. A method according to claim 1, wherein the containers, after filling, are covered by a covering which engages at least end walls and/or side walls of the container.

4. A method according to claim 3, wherein the containers are covered by a foil which is sealed onto the side walls and/or the end walls of the container.

5. A method according to claim 4, wherein the foil is sealed on the upper longitudinal edges of the end walls and the side walls of the container, for forming a complete sealing of the open upper side of the container.

6. A method according to claim 1, wherein the containers are manufactured from a plastic, resistant to temperatures below 0 degrees Centigrade, which plastic is recyclable and, additionally, sealable through thermal welding, heat sealing, or the like, or to which hot- or cold-melt glues adhere.

7. A method according to claim 1, wherein, between cycles of use, the containers are cleaned with steam, whereby the containers are sterilized.

8. A foldable container, which is injection-molded from plastic in one piece with integrated hinges, wherein the container is provided with a bottom, two end walls and two side walls, wherein the bottom is tray-shaped and comprises four upwardly extending edges from a bottom plate, wherein the end walls are at least substantially foldable within the bottom between said edges, and the side walls are substantially foldable over the end walls, wherein the end walls are each integrally connected to said bottom by a respective lip provided at the outside of said bottom, each of said lips being respectively connected to an outside surface of one of said upwardly extending edges of said bottom.

9. A foldable container according to claim 8, wherein the container is injection-molded substantially flat, and wherein said lips, after injection molding, are fixed to the sides of the bottom, such that the connections between the lips and the respective end walls are situated above the upper longitudinal edge of the bottom on the respective sides and form hinge means for the end walls.

10. A foldable container according to claim 8, wherein the side walls and the end walls are also substantially tray-shaped, with the container set up, the end walls and/or the side walls extend at least partly outside the outer contour of the bottom, such that a plurality of said containers can be stacked by positioning the bottom of a superjacent container between the side walls and the end walls of a subjacent container, the side walls and/or the end walls of the superjacent container resting on those of the subjacent container.

11. A foldable container according to claim 8, wherein the end walls have a width being approximately equal to the corresponding width of the bottom, and the side walls have a length greater than the corresponding length of the bottom, such that, with the container set up, the parts of the side walls protruding on both sides outside the bottom abut the sides of the end walls, while coupling means are provided for coupling the end walls with the side walls.

12. A foldable container according to claim 11, wherein the coupling means are arranged for form- or force-closed coupling as a detachable pin-hole connection.

13. A foldable container according to claim 8, wherein the side walls and/or the end walls of the container are provided with cooperating sealing means which, with the container set up, provide substantially closed ribs.

14. A foldable container according to claim 8, wherein the container is manufactured from recyclable and sterilizable plastic.

15. A one-piece injection molded container comprising:

a tray shaped bottom having a bottom plate and a peripheral edge extending upwardly from said bottom plate; a foldable end wall integrally connected to an outer surface of said peripheral edge, said end wall having a first sub-hinge connected to a lower portion of said peripheral edge outer surface, a lip extending from said first sub-hinge and fixed to said peripheral edge outer surface, a second sub-hinge disposed at an end of said lip opposite said first sub-hinge and a wall part extending from said second sub-hinge, wherein said wall part is pivotable about said second sub-hinge between a set-up position, wherein said wall part extends upwardly from said second sub-hinge substantially perpendicular to said bottom plate, and a folded position, wherein said wall part is disposed within said peripheral edge of said bottom substantially parallel with said bottom plate; and a side wall integrally connected to said bottom, said side wall being foldable over said end wall when said end wall is in said folded position.

16. A one-piece injection molded container as defined in claim 15, wherein said end wall and said side wall include an integral lock for locking said end wall to said side wall when said end wall is in said set-up position.

17. A one-piece injection molded container as defined in claim 16, wherein said integral lock comprises an integral pin formed on one of said end wall and said side wall and an opening formed in the other of said end wall and said side wall, said pin being received in said opening for locking said end wall to said side wall when said end wall is in said set-up position.

* * * * *

UNITED STATES PATENT AND TRADEMARK OFFICE

CERTIFICATE OF CORRECTION

PATENT NO. : 7,178,311 B2
APPLICATION NO. : 10/475077
DATED : February 20, 2007
INVENTOR(S) : Hoogland It is certified that error appears in the above-identified patent and that said Letters Patent is hereby corrected as shown below:

Column 1 line 61, now reads "further related"

should read --further relates --

Column 3, line 46, now reads "lip 13"

should read --lip 16--

Column 4, line 37, now reads "one the upper edge"

should read --on the upper edge --

Column 4, line 50, now reads "from a side"

should read --from a silo--

Column 5, line 40, now reads "the crates in then"

should read --the crates is then--

Signed and Sealed this

Seventh Day of August, 2007

JON W. DUDAS
*Director of the United States Patent and Trademark Office*